United States Patent [19]

Bevilacqua et al.

[11] Patent Number: 4,820,359

[45] Date of Patent: Apr. 11, 1989

[54] PROCESS FOR THERMALLY STRESS-RELIEVING A TUBE

[75] Inventors: Bruce W. Bevilacqua, Penn Township, Westmoreland County; Wenche W. Cheng, Monroeville; Donald R. Stoner, Murrysville Boro; Fredric W. Pement, Pittsburgh; Robert D. Burack, Pleasant Hills; Joseph M. Gilkison, Murrysville Boro, all of Pa.

[73] Assignee: Westinghouse Electric Corp., Pittsburgh, Pa.

[21] Appl. No.: 24,941

[22] Filed: Mar. 12, 1987

[51] Int. Cl.[4] ..... H05B 3/06; B23K 1/02

[52] U.S. Cl. ..... 148/127; 148/11.5 N; 148/13.1; 148/128; 219/534; 219/535; 219/549

[58] Field of Search ..... 148/127, 128, 13.1, 148/11.5 N; 219/534, 535, 549

[56] References Cited

U.S. PATENT DOCUMENTS

| | | | |
|---|---|---|---|
| 3,275,803 | 9/1966 | True | 219/535 |
| 3,288,980 | 11/1966 | Rohrberg et al. | 219/125 |
| 4,046,596 | 9/1977 | Metcalfe et al. | 148/127 |
| 4,168,190 | 9/1979 | Eguchi et al. | 148/127 |
| 4,326,897 | 4/1982 | Ruhe et al. | 148/13.1 |
| 4,336,312 | 6/1982 | Clark et al. | 148/127 |
| 4,354,883 | 10/1982 | Terasaki | 148/127 |
| 4,464,565 | 8/1984 | Spangler | 219/535 |
| 4,490,186 | 12/1984 | Sines et al. | 148/127 |
| 4,497,673 | 2/1985 | Esser | 148/127 |
| 4,523,177 | 6/1985 | Driggers | 338/303 |
| 4,572,938 | 2/1986 | Driggers et al. | 219/85 B |
| 4,574,172 | 3/1986 | Burack et al. | 219/10.49 |
| 4,608,101 | 8/1986 | Umemoto | 148/127 |
| 4,631,392 | 12/1986 | O'Brien et al. | 219/549 |
| 4,694,131 | 9/1987 | Ino | 148/127 |
| 4,700,040 | 2/1987 | Driggers | 219/85 R |
| 4,700,053 | 12/1986 | Driggers et al. | 219/523 |
| 4,736,092 | 4/1985 | Pirl et al. | 219/523 |

FOREIGN PATENT DOCUMENTS

| | | | |
|---|---|---|---|
| 1067694 | 5/1979 | Canada . | |
| 2580134 | 4/1986 | France . | |
| 53-66817 | 6/1978 | Japan . | |
| 0160505 | 12/1979 | Japan | 148/127 |
| 60-106921 | 6/1985 | Japan . | |
| 60-121227 | 7/1985 | Japan . | |
| 60-135526 | 7/1985 | Japan . | |
| 1170516 | 8/1986 | Japan | 148/127 |

OTHER PUBLICATIONS

EPRI Document No. NP-2629LD "Evaluation of Steam Generator U-Bend Tubes from the Trojan Nuclear Power Plant" Sep., 1982, by Aspden and Kurchirka.

EPRI Document No. NP-3056 "In Situ Heat Treatment and Polythionic Testing of Inconel 600 Row One Steam Generator U-Bends," Apr., 1983, by Gilkison.

EPRI Document No. NP-5496 "In Situ Heat Treatment of U-Bends" Nov. 1987 by Pement, Econcomy and Aspden.

EPRI Document No. PT-3051 "Optimization of Metallurgical Variable to Improve Corrosion Resistance on Inconel Alloy 600," Jul., 1983 & Dec. 1982, by Airey.

*Primary Examiner*—Upendra Roy

[57] ABSTRACT

A process for thermally stress-relieving a stressed portion of a metallic tube is disclosed herein. The process generally comprises the steps of inserting a small diameter radiant heater into the open end of the metallic conduit and then positioning it adjacent to the portion to be stress relieved, and heating this portion to a temperature between about 1150° F. to 1500° F. for a time period of between about four and twelve minutes, depending upon wall thickness. In order to determine the proper amount of electrical power to apply to the radiant heater, the emissivity of the stressed portion of the conduit is first measured by heating a portion of the section to incandescence at a known power level, and then determining the temperature of the incandescent tube by means of a pyrometer which compares the intensity of two selected colors or wavelengths of the transmitted light. This process is particularly useful in thermally stress-relieving the U-bends of heat exchanger tubes formed from Inconel® 600 that are used in nuclear steam engines. It may also be used to stress-relieve such heat exchanger tubes in regions where the reinforcing sleeves have been welded into their interiors. Such thermal stress relieving renders the tubes less susceptible to intragranular stress corrosion cracking.

30 Claims, 3 Drawing Sheets

PROCESS FOR THERMALLY STRESS-RELIEVING A TUBE

BACKGROUND OF THE INVENTION

This invention generally relates to a process for thermally stress-relieving a selected portion of a metallic conduit, such as the U-bend section or a welded section of a heat exchanger tube formed from Inconel ® 600 of the type used in nuclear steam generators.

Processes for stress-relieving metallic tubes are known in the prior art. These processes might be used, for example, to relieve the tensile stresses which may be induced across the wall of a metallic tube when the tube is either bent around a radius, radially expanded, or welded. Such stress-causing bends are incorporated into the heat exchanger tubes used in nuclear steam generators during their manufacture in order to give them their distinctive U-shape. Stress-causing expansions are routinely generated in the sections of these heat exchanger tubes that extend through the generator tubesheet, both during the manufacture and maintenance of the generator. Finally, stress-causing welds are placed around the interior walls of these tubes whenever reinforcing sleeves are welded therein.

Unfortunately, the tensile stresses that result from bending, expanding or welding the tube walls may lead to an undesirable phenomenon known as "stress corrosion cracking" if these stresses are not relieved. However, in order to fully understand the dangers associated with such stress corrosion cracking, and the utility of the invention in preventing such cracking, some general background as to the structure, operation and maintenance of nuclear steam generators is necessary.

Nuclear steam generators are comprised of three principal parts, including a secondary side, a tubesheet, and a primary side which circulates water heated from a nuclear reactor. The secondary side of the generator includes a plurality of U-shaped heat exchanger tubes, as well as an inlet for admitting a flow of water. The inlet and outlet ends of the U-shaped tubes within the secondary side of the generator arè mounted in the tubesheet that hydraulically separates the primary side of the generator from the secondary side. The primary side in turn includes a divider sheet which hydraulically isolates the inlet ends of the U-shaped tubes from the outlet ends (see FIG. 1A). Hot, radioactive water flowing from the nuclear reactor is admitted into the section of the primary side containing all of the inlet ends of the U-shaped tubes. This hot, radioactive water flows through these inlets, up through the tubesheet, and circulates around the U-shaped tubes which extend within the secondary side of the generator. This water from the reactor transfers its heat through the walls of the U-shaped tubes to the nonradioactive feed water flowing through the secondary side of the generator, thereby converting feed water to nonradioactive steam that in turn powers the turbines of an electric generator. After the water from the reactor circulates through the U-shaped tubes, it flows back through the tubesheet, through the outlets of the U-shaped tubes, and into the outlet section of the primary side, where it is recirculated back to the nuclear reactor.

The walls of the heat exchanger tubes of such nuclear steam generators can suffer from a number of different forms of corrosion degradation, one of the most common of which is intragranular stress corrosion cracking. Empirical studies have shown that the heat exchanger tubes may be more susceptible to stress corrosion cracking wherever they acquire significant amounts of residual tensile stresses, whether by bending, radial expansion, or welding. Where bending is concerned, the smaller radiused U-bends contain higher residual stresses and thus are more susceptible to stress corrosion cracking. These tubes are located near the center of the tubesheet (i.e., what are known as the "row 1" and "row 2" tubes). Tubes in row 1 have bend radii as small as approximately two inches. Applicants have recently found that a significant percentage of these centrally located heat exchanger tubes have exhibited stress corrosion cracking, primarily at the tangent-point where the semi-circular "elbow" of the U-shaped bend melds in with the straight-leg sections of the tube (see line "T" in FIG. 1B). Where tube expansions are concerned, such stress corrosion cracking has been displayed where the tubing has been radially expanded in order to minimize the annular clearance between the outer walls of the tube, and the holes bored through the tubesheet that receive the tubes. Here, it has been found that the cracking has manifested itself most frequently in what are known as the "transition zones" of the expansion, or the tapered sections of the tubes where the expanded portion melds in with the unexpanded portion of the tube (see no. 19 in FIG. 1B). Where welding is concerned, it has been found that such stress corrosion cracking may occur in the heat affected zone on either side of a circular weld joining a reinforcing sleeve to the inner wall of a heat exchanger tube (see No. 19.3 in FIG. 1B).

If such stress corrosion cracking is not prevented, the resulting cracks in the tube can cause the heat exchanger tubes to leak radioactive water from the primary side into the secondary side of the generator, thereby radioactively contaminating the steam produced by the steam generator.

In order to prevent such corrosion and tube cracking from occurring in the U-bend, expanded sections and welded sections of the heat exchanger tubes, various mechanical stress-relieving processes have been developed. One example of such a process is disclosed in U.S. Pat. No. 4,481,802 invented by Mr. Douglas G. Harmon et al. and assigned to the Westinghouse Electric Corporation. In this process, a shaft having a peening strip affixed thereto is inserted into a heat exchanger tube and rotated. The small peening balls attached to the rotating peening strip act as tiny hammers against the inner walls of the tube, and serve to relieve any residual tensile stresses therein. Processes for thermally stress relieving the stressed sections of such heat exchanger tubes are also known in the prior art. In such processes, the stressed section of the tubing is heated to a temperature sufficient to bring the tube walls into a plastic state, thereby allowing the microstructure of the walls to shift and to relieve any stresses contained therein.

Unfortunately, such prior art stress-relieving processes are not without limitations. While mechanical stress-relieving processes such as rotopeening have proven to be effective in relieving the stresses in the transition sections of the bottom portions of the heat exchanger tubes that have been expanded against the bores of a tubesheet, and might also be used where sleeves have been welded onto the interior walls of the tubes, such processes are difficult to apply to the U-bend sections of these tubes. Since the tubes are often about thirty feet in length, it is difficult (if not impossible) to effectively feed and drive a flexible peening shaft all the way up to and over the U-bend section of the heat exchanger tube. These problems are compounded when one attempts to bend a flexible rotopeening shaft around the smallest radiused U-bends that are the most needful of stress relief. The problems associated with mechanical stress relief led the applicants to consider thermally stress-relieving such U-bend sections. However, such thermal processes suffer two drawbacks. First, up until recently, there was no known heater capable of applying the necessary heat thirty feet up into the tube adjacent to the U-bend section in a practical manner. However, this problem has been solved by the recent invention of the flexible radiant heater described and claimed in U.S. Ser. No. 864,619 filed May 16, 1986, by John M. Driggers, Bruce Bevilacqua and Thomas Saska, and assigned to the Westinghouse Electric Corporation. The second drawback associated with such processes was the long amount of time it would take to apply enough heat to the U-bend section of the heat exchanger tube before the stresses within it are effectively relieved. It is known that the application of temperatures between 1,000° and 1,100° F. for about an hour are capable of relieving the tensile stresses in tubing formed from Inconel ® 600. While the use of higher temperatures could significantly reduce the heating time, the prior art indicates that such temperatures might adversely affect the microstructure of the Inconel ® 600 alloy used in such tubes, and thereby negate the benefits associated with stress relief. For example, it is known that the tensile stresses in a section of Inconel ® 600 may be removed if the tube section is heated to 1500° F. for a period of about 15 minutes. But under such conditions, some heats (or batches) of Inconel ® 600 exhibited an enlarged grain growth as a result of such heating, which indicates a heightened susceptibility to corrosion as well as a reduction in mechanical properties. The exposure of Inconel ® 600 to temperatures higher than 1500° F. has been shown to remove certain carbide precipitates from the grain boundaries of the metal, which also indicates a heightened susceptibility to corrosion.

Accordingly, there is a need for a thermal stress relieving process that is capable of effectively relieving the tensile stresses in the remote, small radiused U-bend sections of the Inconel ® heat exchanger tubes used in steam generators in a manner that is both rapid and effective. Such a method should be easy and inexpensive to implement, and capable of accurately, uniformly and reliably heat treating either the U-bend sections of these tubes or their transition zones or welded sections regardless of differences in their thermal loss properties or metallurgical properties. Finally, since there may be as many as eighty different heats of Inconel ® 600 tubing in the forty miles of tubing typically used in a nuclear steam generator, the process should not be sensitive to the small but significant differences in metallurgical properties between different heats.

SUMMARY OF THE INVENTION

Generally, the invention is a process for thermally stress-relieving a section of a metallic conduit by means of a heater assembly that is readily positioned and movable within the conduit. The process comprises the steps of inserting the heater into the open end of the conduit and positioning it adjacent to a portion of the section to be stress-relieved, heating this portion to between about 1150° F. and 1500° F., maintaining this temperature for a time period of between about four and twelve minutes, and withdrawing the heater from the conduit. When a flexible heater is used, the process is particularly well adapted for thermally stress-relieving the U-bends of the Inconel ® 600 heat exchanger tubes in nuclear steam generators.

In one preferred embodiment of the process, a flexible radiant heater is used to heat the entire U-bend section (as well as the portions of the heat exchanger tube adjacent to the tangent points of the U-bend) from between about 1300° F. to 1500° F. for between about five and seven minutes. The use of such a range of temperatures for the previously mentioned time periods has been found to effectively relieve stress in all heats of Inconel ® 600 tubes in a minimum amount of time without adversely effecting the microstructure of the metal. This preferred embodiment process may also be used to thermally stress-relieve the transition sections around portions of heat exchanger tubes that have been radially expanded either in the tubesheet region or in the support plate region of a nuclear steam generator.

In another preferred embodiment of the process, a radiant heater (which need not be flexible) is used to heat the heat affected zone surrounding a ring-shaped weld that secures a reinforcing sleeve to the interior walls of a heat exchanger tube. In this embodiment, the tube-sleeve combination is heated to within the same temperature range, but for a time period of between about eight and twelve minutes to compensate for the greater thermal mass resulting from the double-wall thickness.

The process further includes the step of determining the thermal loss properties of the U-bend section or transition zone section or weld zone of the tube prior to thermally stress-relieving it to determine the power level necessary to heat it to between 1150° F. and 1500° F. In this step, the thermal loss properties that result from the tubes' emissivity are determined by heating a statistical sample of the tubes to incandescence while supplying a known amount of electrical power to the heater, and then remotely inspecting the light from this incandescence by means of a two-color pyrometer in order to determine the resulting temperatures of the tubes.

BRIEF DESCRIPTION OF THE SEVERAL FIGURES

DETAILED DESCRIPTION OF THE PREFERRED EMBODIMENT

Figure 1A:
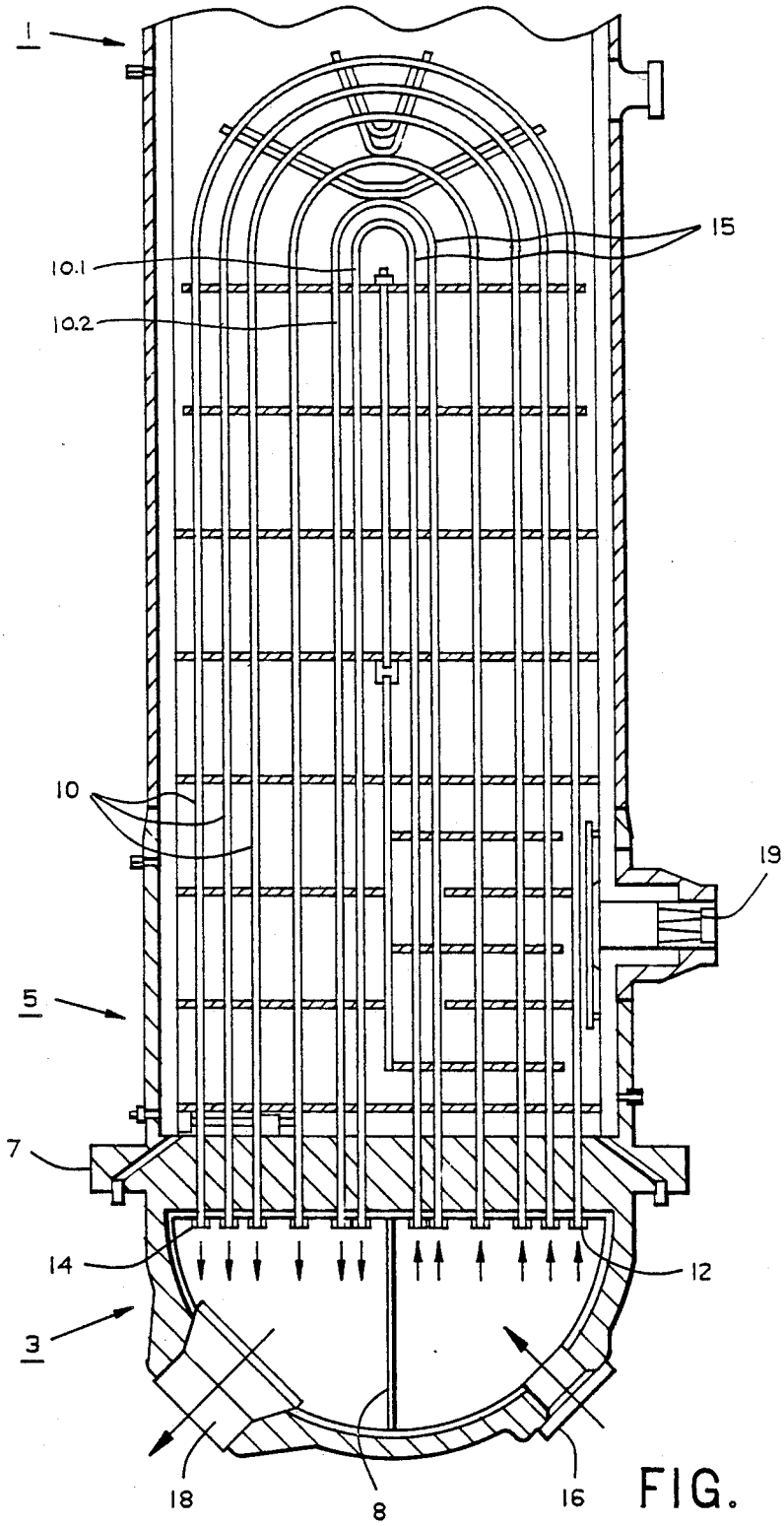
FIG. 1A is a cross-sectional side view of a nuclear steam generator illustrating the U-shaped heat exchanger tubes that the process of the invention may be used to thermally stress-relieve.

General Description of the Heater Used to Implement the Process of the Invention With reference now to FIG. 1A, wherein like reference numerals designate like components throughout all of the several figures, the invention is particularly adapted for thermally stress-relieving the U-shaped heat exchanger tubes within a nuclear steam generator 1. Such generators generally include a bowl-shaped primary side 3 which underlies a cylindrically shaped secondary side 5. A tubesheet 7 hydraulically isolates the primary side 3 from the secondary side 5. A divider sheet 8 further hydraulically divides the bowl-shaped primary side 3 into an inlet side and an outlet side.

A plurality of U-shaped heat exchanger tubes 10 extend up in the secondary side 5 of the generator 1. Each of the U-shaped tubes includes an inlet end 12 which communicates with the inlet side of the primary side 3, and an outlet end 14 which communicates with the outlet side of the primary side 3. Hot, radioactive water circulating through the nuclear reactor (not shown) enters into an inlet 16 in the inlet side of the primary side 3, where it in turn flows into the inlet ends 12 of the U-shaped heat exchanger tubes 10. This water circulates upwardly through the "hot legs" of the tubes 10, around the U-bend sections 15 thereof, and down toward the outlet side of the primary side 3 through the "cold legs" of these tubes (see flow arrows). This water is then discharged into the outlet side of the primary side 3, where it flows out of the primary outlet 18 and back into the nuclear reactor for re-heating. Each of the tubes 10 is typically formed from Inconel® 600, with an outer diameter of 0.875±0.005 inches, an inner diameter of 0.775±0.005 inches, and a wall thickness of between 0.048 and 0.053 inches.

While hot, radioactive water circulates through the U-shaped heat exchanger tubes 10 of the generator 1, nonradioactive water is admitted into the secondary side 5 of the generator 1 through the secondary water inlet 19. The heat transferred from the inner to the outer walls of the U-shaped heat exchanger tubes 10 causes the water in the secondary side 5 of the steam generator 1 to boil, thereby creating nonradioactive steam which is ultimately used to power the generator turbines of an electrical power plant (not shown).

As is evident in FIG. 1A, the U-shaped heat exchanger tubes 10 whose inlet ends 12 and outlet ends 14 are mounted closest to the divider sheet 8 have the smallest-radiused U-bend sections 15. The centermost tubes 10.1 and 10.2 are referred to as "row 1" and "row 2" tubes, respectively. The smallest-radiused U-bends 15 are present on the row 1 tubes 10.1, whose radius may be as short as two inches. The forming processes which impart such small-radiused U-bend sections 15 in such tubes 10 frequently impart a substantial amount of residual tensile stresses in these sections 15. As is evident in FIG. 1B, each of the legs of the heat exchanger tubes 10 terminates in end portions 17 which extend through bores 17.1 present in the tubesheet 7. These end portions 17 are frequently radially expanded (by hydraulic mandrels or cold-rolling) so that little or no annular clearance is present between the outer walls of the tubes 10, and the surface of the bores 17.1. Such expansions create frustoconically shaped transition sections 19 between the expanded end portions 17 of the tubes 10, and the unexpanded balance of the tube 10. The expansion processes that create the expanded portions 17 of the tubes 10 also impart a substantial amount of tensile stresses in these transition sections 19. Finally, some of the tubes 10 may include reinforcing sleeves 19.1 whose ends (only one of which is shown) are secured around the interior walls of a tube by a 360° weld 19.2 that is surrounded by a ring-shaped heat-affected zone 19.3. The application of the welding heat creates substantial tensile stresses in the sections of both the tube 10 and the sleeve 19.1 that are in the heat-affected zone 19.3. Applicants have discovered that such substantial stresses accelerate the extent to which the U-bend sections 15, transition sections 19 and heat-affected zones 19.3 may be attacked by corrosion within the secondary side 5 of the steam generator 1.

Figure 1B:
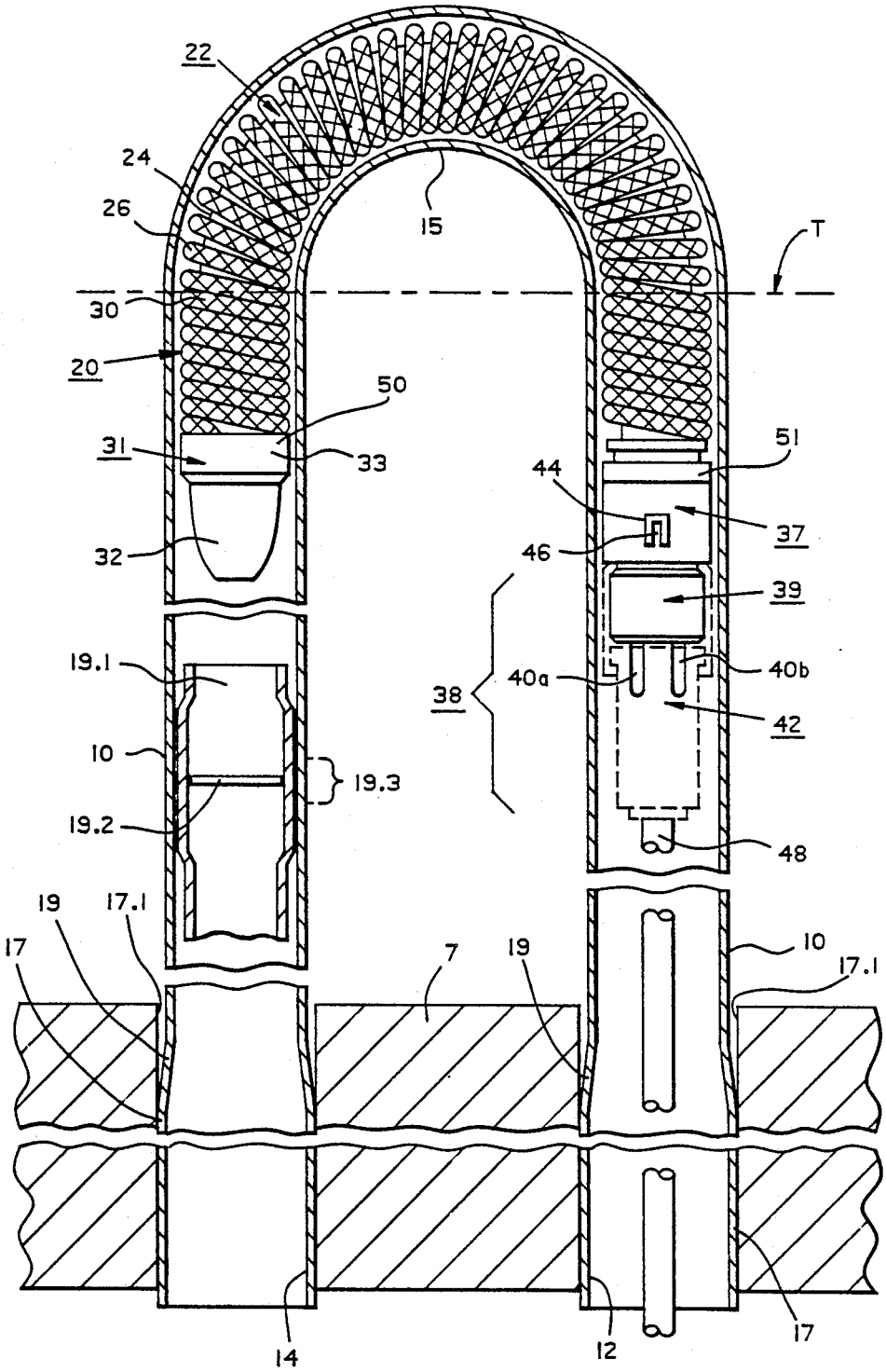
FIG. 1B is a cross-sectional side view of the flexible radiant heater used to implement the process of the invention as it appears positioned across a U-bend of one of the heat exchanger tubes illustrated in FIG. 1A.

FIG. 1B further discloses the heater assembly 20 of the invention which is particularly adapted for thermally stress relieving such corrosion causing tensile stresses in the U-bend sections 15, and which also may be used to stress-relieve the transition sections 19 and heat-affected zones 19.3. Heater assembly 20 includes an elongated, flexible mandrel 22. In its middle portion, the mandrel 22 includes a coil spring 24 formed from a heat-resistant alloy, such as Inconel® 600. Wound around the outside of the spring 24 is a heating coil 26. The interior of each of the windings of the heating coil 26 is formed from braided strands of electrically resistive wire fabricated from a platinum-rhodium alloy, while the exterior of each of these windings is formed from a braided sleeve 30 of heat resistant and electrically insulative fibers, such as alumina fibers. The insulating sleeve 30 prevents the windings of braided wire from short circuiting through either the metallic coil spring 24, or the inner walls of the metallic tubes 10. In the preferred embodiment, the flexible insulating sleeve 30 is a sleeve approximately one-eighth of an inch in diameter formed from braided Nextel® 440 fibers which are now available from the Minnesota Mining and Manufacturing Company, located in St. Paul, Minn. In addition to the previously mentioned insulating functions, this sleeve 30 further prevents short circuiting from occurring between adjacent windings of the braided wire, and serves to uniformly space these adjacent windings apart so that the heat gradient generated by the heating coil 26 is free from thermal nonuniformities or hot spots. The specific structure of the interior of the middle portion of the mandrel 22 is set forth in the previously mentioned U.S. patent application Ser. No. 864,619 filed May 16, 1986, the entire specification of which is expressly incorporated herein by reference.

Located in the interior of the mandrel 22 is a rod-like reinforcing member (not shown) which is preferably formed from Inconel®. This reinforcing member reinforces both the tensile and compressive strength of the spring 24. The rod-like reinforcing member is surrounded by a plurality of ceramic beads (also not shown) preferably formed from high-purity magnesia. These beads include centrally disposed bores which allow them to be slidably threaded onto the rod-like member. Additionally, each of the beads includes a frusto-conical projection at its front and a complementary frusto-conical recess in its rear so that some degree of nesting occurs between adjacent beads. These beads, and their mutual inter-nesting, lend additional shear strength to the mandrel 22 as a whole. A tubular sleeve of Nextel® surrounds the in-tandem beads in order to prevent any binding from occurring between the edges of the beads and the coils of the spring 24 when the mandrel 22 is bent. This sleeve, in combination with the beads, also serves to insulate the rod-like reinforcing member from the heat radiated from the heating coil 26.

At its distal or front portion, the mandrel 22 includes a nosepiece assembly 31 for facilitating the insertion of the mandrel 22 through the open end of a tube 10. This nosepiece assembly 31 includes a forward nosepiece 32 for protecting a coil connecting portion of the heating coil 26, as well as a rear nosepiece 33 whose precise function will become evident presently. In the preferred embodiment, the forward nosepiece 32 is formed from No. 304 stainless steel, while the rear nosepiece 33 is formed from 99.9% pure boron nitride that is diffusion bonded. As is evident in FIG. 1B, the forward nosepiece 32 has a bullet-shaped profile. This rounded profile allows the flexible mandrel 22 of the heater assembly 20 to be pushed through a small-radiused U-bend 15 with a minimum amount of stress on the heater assembly 20 and without scratching or scouring the interior surface of the U-bend 15. The nosepiece assembly 31 also provides a front anchor point for the rod-like reinforcing member (not shown) that extends throughout the center of the mandrel 22.

At its rear or proximal portion, the flexible mandrel 22 includes an endpiece 37 formed from No. 304 stainless steel. One of the principal purposes of the endpiece 37 is to provide a rear anchor point for the distal end of the rod-like reinforcing member. Endpiece 37 also serves to protect the rearmost windings of the heating coil 26 from mechanical shock. In the preferred embodiment, the endpiece 37 includes a fiber-optic window 44 for allowing the infra-red radiation emanated by a recently treated tube 10 to strike an optical fiber 46 connected to a pyrometer. The exact structure of the fiber optic window 44 and optical fiber 46 of the female receptacle 42 is similar to the window and fiber disclosed in U.S. Pat. No. 4,700,053 by John J. Driggers et al. and assigned to the Westinghouse Electric Corporation (the entire specification of which is expressly incorporated herein by reference). Located directly behind the endpiece 37 is an electrical connector assembly 38. The connector assembly 38 is generally formed from a male connector 39 which terminates in a pair of connector pins 40*a*, 40*b* and a female receptacle 42 for receiving these pins.

A flexible cable 48 is connected to the rear or proximal end of the female receptacle 42. In the preferred embodiment, this flexible cable 48 extends through a bore present in the female receptacle 42 and is anchored thereto by means of stainless steel sleeve. In the preferred embodiment, the cable 48 is formed from a braided 3/16-inch diameter cable formed from No. 316 stainless steel.

In addition to providing anchor points for the reinforcing member, both the nosepiece assembly 31 and the endpiece 37 provide an enlarged, annular shoulder 50 and 51 at the ends of the mandrel 22 that protects the relatively delicate windings of the heating coil 26 from friction and mechanical shock. These shoulders 50 and 51 also serve the important function of concentrically spacing the windings of the heating coil 26 around the longitudinal axis of the tube 10, which in turn results in a uniform heating gradient in the section of the tube adjacent to the heating coil 26. In the preferred embodiment, the length of the heating coil 26 between the shoulders 50 and 51 is at least three inches longer than the length of the U-bend portion 15. Such dimensioning allows the proximal and distal ends of the heating coil 26 to heat not only all of the U-bend 15, but at least one-half inch of the tube 10 beneath the tangent points (indicated by the line T) where the elbow ends of the U-bend meld into the hot and cold legs of the tube 10. The end result of such dimensioning is that the heater assembly 20 is capable of heating not only all of the U-bend 15, but the tangent point regions of the tube 10 in a single operation, thereby minimizing the amount of time necessary to execute the process of the invention. The ability to heat treat both tangent point regions of the tube in a single operation is a particularly important feature, since the applicants have found that these sections are the most susceptible to stress corrosion cracking.

Figure 2:
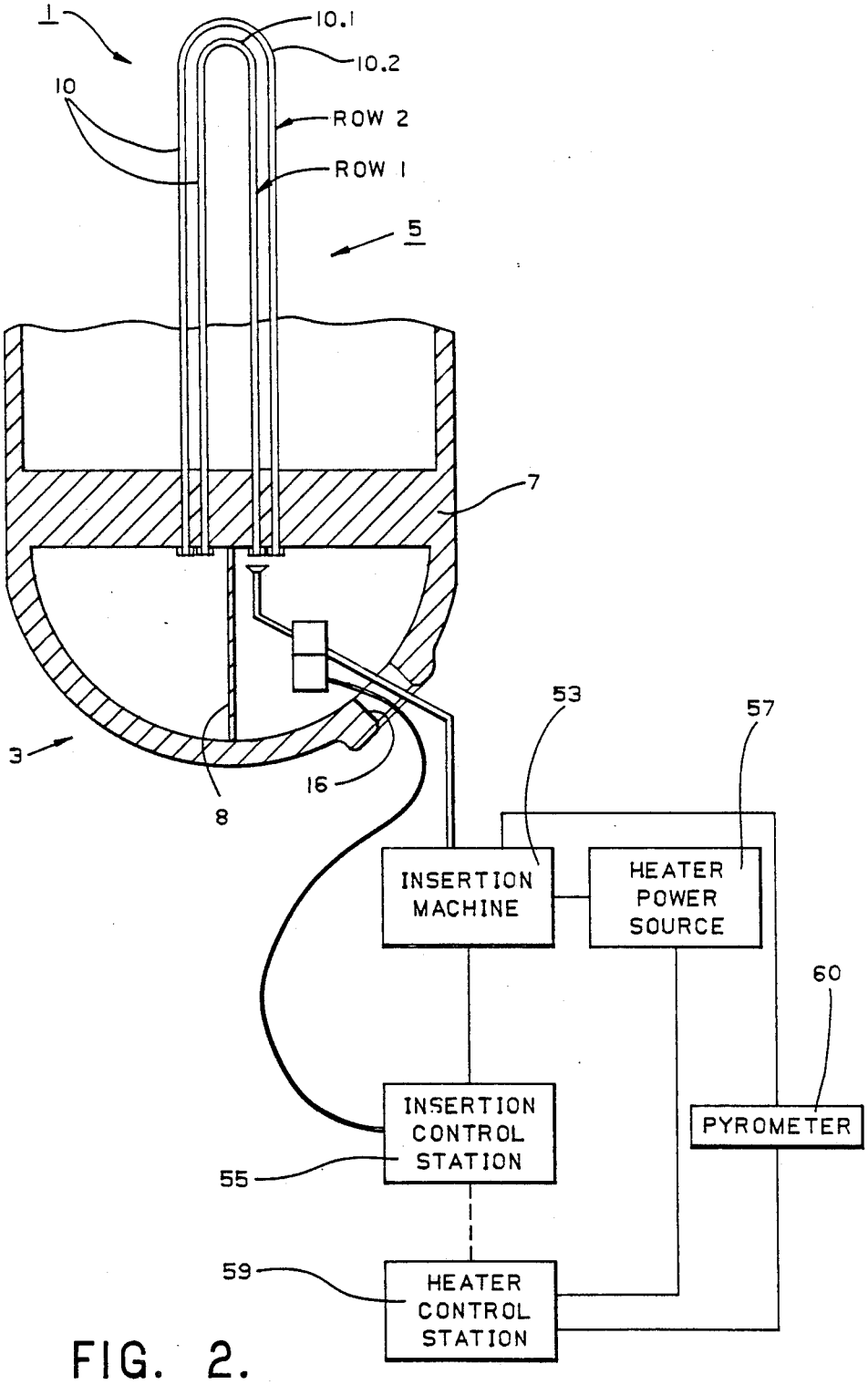
FIG. 2 is a schematic diagram of the heater system used to implement the process of the invention.

FIG. 2 illustrates, in schematic form, the balance of the components used to implement the process of the invention. Briefly these components include an insertion machine 53, an insertion control station 55, a heater power source 57, a heater control station 59, and a pyrometer 60. The insertion machine 53 inserts the heater assembly 20 into the open end of a selected heat exchanger tube 10 and conveys it to the vicinity of the U-bend 15. In the preferred embodiment, the insertion machine 53 is a combination of two commercially available robotic devices, including a Model SM10-W manipulator and a Model D-3 probe carrier, both of which are manufactured by Zetec, Inc. located in Isaquah, Wash. The Model SM10-W positions the heater assembly 20 under the open end of the selected tube 10, while the Model D-3 conveys it to the U-bend 15. The insertion control station 55 includes a pop-up mechanism that is used to momentarily slide the heater assembly 20 three and a half inches forward from the position illustrated in FIG. 1B to place the optical fiber 46 adjacent to a heated portion of the U-bend 15 to determine its temperature. Generally speaking, the pop-up mechanism of the insertion control station 55 is formed from an expandible bladder-type gripper which is reciprocably movable of the type disclosed and claimed in U.S. patent application Ser. No. 785,291 and U.S. Pat. No. 4,713,664 both of which were filed Oct. 5, 1985 by William E. Pirl and assigned to the Westinghouse Electric Corporation, the entire specifications of which are each expressly incorporated herein by reference.

In addition to being mechanically linked to both the insertion machine 53 and the insertion control station 55, the heater assembly 20 is electrically connected to a heater power source 57 that is in turn controlled by a heater control station 59. In the preferred embodiment, the heater power source 57 is a three kilowatt, 220 VAC source of electricity, and the heater control station 59 includes a microprocessor for the control of an SCR chopped wave power supply for adjusting the voltage of the power source 57 from anywhere between 0 and 220 VAC. Finally, the optical fiber 46 of the heater assembly is optically coupled to the pyrometer 60. The pyrometer 60 is preferably a Model No. 9210B manufactured by Williamson, Inc. of Concord, Mass., although any one of a number of two-color pyrometers may be used. Two-color pyrometers are preferred in the invention for two reasons. First, such a pyrometer is not light-intensity-dependent. Therefore, any light intensity variations which occur due to clouding of the optical fiber 46 will not create temperature variations in the readings generated. Secondly, such a pyrometer 60 provides an instantaneous readout of the temperature of the section of the U-bend 15 heated. This is important, since the temperature tends to drop off quickly once the heater assembly 20 is moved to a different location within the tube 10.

In the preferred process of the invention, the heater assembly 20 is inserted into the open end of a leg of the tube 10 whose U-bend 15, transition section 19 or heat-affected zone 19.3 is to be heat treated. If the steam generator is "cold" (i.e., devoid of radioactivity), the insertion step may be performed manually. However, if the generator has been on-line, and is "hot", the commercially available robots that form the insertion machine 53 are preferably used.

Once the heater assembly 20 has been inserted into the appropriate heat exchanger tube 10, the insertion machine 53 is further used to slide the heater assembly 20 up into a position that is adjacent to either the U-bend 15, the transition section 19, or heat-affected zone 19.3 of the tube 10. In the case of a U-bend 15, the heater assembly 20 is preferably placed in the position illustrated in FIG. 1B.

When the heater assembly 20 has been so positioned, the emissivity of the first U-bend 15 or other section 19, 19.3 to be heat treated is determined by heating the section in question to a steady-state (or "soak") temperature at a known power level through the heater control station 59. Both the power level and the heating time are selected so that the section 15, 19, 19.3 is heated to incandescence. In the case of a U-bend 15, this typically amounts to a power level of about 1.2 KW after a ramp time of about 6 minutes and a soak time of about 1 minute. At the expiration of this time period, the pop-up mechanism of the insertion control station 55 is used to push the heater assembly 20 completely through the U-bend or other section 19, 19.3 so that the optical fiber 46 is placed adjacent to a portion of the U-bend 15 or other section 19, 19.3 which is now glowing with cherry-red light. The optical fiber 46 transmits this light to the pyrometer 60, which in turn determines the relative radiant energy which is used to identify the temperature. The emissivity of the U-bend 15 or other section 19, 19.3 is then computed from the tube temperature, the applied power (voltage and current) conducted through the heating coil 24, and the resistance (in ohms) of the electrical resistance element within the heating coil 26. In more specific terms, the emissivity e is computed by means of the following formula: $e = I^2R/\sigma KA(T1^4 - T2^4)$, wherein I equals the amperage conducted through the heating coil 26, R equals the resistance of the heating coil 26, $\sigma$ is the Stephan-Boltzman constant, T1 is the measured temperature, T2 is 400° F., (an empirically derived temperature), A is the surface area of the heating coil 26, and K is an empirically derived constant based on tube geometry. Once the emissivity of the U-bend 15 or other section 19, 19.3 is determined, then the level of the power necessary to heat it to between 1150° and 1500° F. (and most preferably 1400° F.) may be computed by means of the same formula.

In the next step of the process, the heating assembly 20 is placed back into the position illustrated in FIG. 1B in order to carry out the thermal stress-relieving step. When the heater assembly 20 is so repositioned, care must be taken in the case of a U-bend 15 so that the ends of the heating coil 24 are placed below the tangent points (indicated by the line T) so that not only the U-bend 15 itself is heated, but at least one-half of an inch of the tube 10 on either side of the U-bend 15. Such positioning of the heater assembly 20 ensures not only that the U-bend 15 itself will be completely heat treated, but also the regions of the tube 10 adjacent thereto. This is important, since the general pattern of stress corrosion cracking (when it does occur) seems to occur on or around tangent points indicated by the tangent line T.

Once the heater assembly 20 has been repositioned in the manner described, the heating coil 26 is reconnected to the heater power source 57 through the heater control station 59. In order to minimize the amount of time required to bring the heating coil 26 to its final heating level without damaging the electrical heating element within the coil 26, a seven part power ramp is used. Assuming that the resistance of the coil 26 when hot is about 7.5 ohms (dependent on length and diameter), the voltage of the current conducted through the coil 26 is varied as follows: (1) about 41 VAC for 6 seconds; (2) about 51 VAC for 10 seconds; (3) about 70 VAC for 14 seconds; (4) about 85 volts for 30 seconds; (5) about 92.5 VAC for 15 seconds, and (6) about 85 volts for 45 seconds. The final voltage (adjusted from emissivity) is used for 540 seconds. The use of the emissivity adjusted voltage should result in the heating coil 26 ultimately heating the tube 10 to a temperature of between 1150° and 1500° F. after a time period of between four and six minutes in the case of a single-walled tube structure such as a U-bend 15 or transition zone 19, and proportionally longer in the case of a double-walled tube structure such as the tube/sleeve combination of heat-affected zone 19.3. After approximately six minutes in the case of a U-bend 15 or transition zone 19, or ten minutes in the case of a heat-affected zone 19.3, the temperature of the heat section of the tube 10 is checked by sliding the optical fiber 46 into a position adjacent to the heat section for about 2 seconds, and then repositioning the heater assembly 20 back into its initial section. If the measured, steady-state temperature is between 1150° F. and 1500° F. (and preferably near 1400° F.), the heater is held in place for six minutes in the case of U-bends 15 or transition zones 19, or ten minutes in the case of the heat-affected zone 19.3 of a welded tube/sleeve combination.

After the thermal stress relief has been completed, the heater power source 57 is disconnected from the heating coil 26 by the heater control station 59, and the heater assembly 20 is slidably withdrawn from the tube 10 after a cool-off period. In the case of U-bend heat treating, the emissivity of a random sample of at least four of the approximately one hundred row 2 tubes 10.2 is measured. As a verification of the emissivity derived from the sampling, the temperature of at least three row 1 tubes 10.1 is also measured. The average value of the emissivity is then computed, and an average emissivity-adjusted heating voltage is computed that is used for the remainder of the tubes in order to minimize the time necessary to carry out the process. The process is repeated until at least all of the row 1 tubes 10.1 have been thermally stress relieved. In most instances, all of the row 2 tubes 10.2 are also thermally stress relieved. The broad parametric tolerances (±100° F., and ±1 or 2 minutes, depending on structure) are a major advantage of the process of the invention, since such broad tolerances make it easy to implement the process.

Finally, while the process is generally applicable to any type of stainless steel tubing, it is particularly adapted for stress relieving Inconel® 600 tubing having an outer diameter of between 0.680 and 0.880 inches, and is particularly effective in treating such tubes having outer diameters of 0.688±0.006 inches., 0.750±0.005 inches, and 0.875±0.005 inches, and wall thicknesses of 0.040±0.004 inches, 0.043±0.005 inches, and 0.050±0.003 inches, respectively.

We claim:

1. A process for thermally stress-relieving a U-bend section of a nickel alloy conduit having at least one open end by means of a heater comprising the steps of:

(a) inserting said heater into said open end of the conduit and positioning it adjacent to at least a portion of said section;

(b) heating said portion of said section of said conduit to between about 1150 degrees F. to 1500 degrees F.;

(c) maintaining said temperature for a time period of between about 4 and 8 minutes, and (d) withdrawing said heater from said conduit.

2. The process of claim 1, further including the step of determining the thermal loss characteristics of the U-bend section of the conduit prior to heating said conduit to between about 1150 degrees F. to 1500 degrees F.

3. The process of claim 1, wherein said portion of said section of said conduit is heated to between about 1300° F. to 1500° F.

4. The process of claim 1, wherein said temperature is maintained for between about 5 and 7 minutes.

5. The process of claim 1, wherein said nickel alloy conduit is formed from Inconel 600.

6. The process of claim 1, wherein said nickel alloy conduit is a U-shaped heat exchanger tube.

7. The process of claim 1, wherein said heater is a radiant heater that includes an electrical resistance element.

8. The process of claim 1, wherein the length of said heater is greater than the length of said section of said conduit.

9. The process of claim 1, further including the step of re-positioning the heater adjacent to a different portion of said section of said conduit prior to withdrawing said heater from said conduit.

10. A process for thermally stress-relieving a double-walled section of a tube substantially formed from a nickel alloy having at least one open end by means of a radiant heater having an electrical resistance element, comprising the steps of:

(a) inserting said heater into said open end of the tube and positioning it adjacent to at least a portion of said section;

(b) heating said portion of said section of said tube to between about 1200 degrees F. to 1450 degrees F.;

(c) maintaining said temperature for a time period of between about 8 and 12 minutes, and (d) withdrawing said heater from said tube.

11. The process of claim 10, further including the step of determining the thermal loss characteristics of the section of the tube prior to heating said portion of said section to determine the amount of electrical power necessary to conduct through the electrical resistance element to heat said section to between about 1200° F. and 1450° F.

12. The process of claim 10, wherein said portion of said section is formed from Inconel®.

13. The process of claim 10, further including the steps of re-positioning the heater adjacent to another portion of the section of the tube in order to heat said other portion to between about 1200 degrees F. to 1450 degrees F. for between about 8 and 12 minutes, and repeating said repositioning step until all of said section is thermally stress-relieved before withdrawing said heater from said tube.

14. The process of claim 12, wherein said portion of said tube has a wall thickness of between about 0.035 and 0.060 inches and is lined with a sleeve also formed from Inconel® and having the same wall thickness, and is heated to between about 1200 degrees F. for between about 8 and 12 minutes.

15. A process for thermally stress-relieving the U-bend of a U-shaped heat exchanger tube formed from Inconel® 600 and having at least one open end by means of an elongated flexible radiant heater having an electrical resistance element, comprising the steps of:

(a) determining the emissivity of the U-bend of the U-shaped heat exchanger tube in order to determine the amount of electrical power necessary to conduct through the electrical resistance element in order to heat said tube to a temperature of between about 1150 degrees F. and 1450 degrees F.;

(b) inserting the heater into the open end of the tube and positioning it adjacent to at least a portion of said U-bend;

(c) heating said portion of said U-bend to between about 1150 degrees F. and 1450 degrees F. by conducting electric current at the power level determined in step (a) through the electrical resistance element of the heater;

(d) maintaining said temperature in said U-bend portion for a time period between about 5 and 7 minutes, and (e) withdrawing the heater from the tube.

16. The process of claim 15, wherein the heater radiates heat along a length that is greater than the length of the U-bend, and wherein the heater is positioned so that the entire U-bend of the tube is heat treated.

17. The process of claim 15, further including the steps of re-positioning the heater adjacent to another portion of the U-bend in order to heat said other portion at about the same temperature and for about the same time as said first portion and repeating said re-positioning step until all of said U-bend is thermally stress-relieved.

18. The process of claim 15, wherein said tubes include the row 1 and row 1 heat exchanger tubes of a nuclear steam generator.

19. The process of claim 15, wherein said emissivity of the U-bend is determined by heating said U-bend to incandescence, and optically transmitting a portion of the light of incandescence to a pyrometer.

20. A process for thermally stress-relieving a sleeved tube having an open end by means of an elongated radiant heater having an electrical resistance element, wherein the walls of the sleeve have been welded to the walls of the tube, and wherein both the sleeve and the tube are formed from Inconel® 600 comprising the steps of:

(a) determining the emissivity of the sleeved region of the tube in order to determine the amount of electrical power necessary to conduct through the electrical resistance element in order to heat the welded sections of the tube to a temperature of between about 1150 degrees F. and 1450 degrees F.;

(b) inserting the heater into the open end of the tube and positioning it adjacent to a welded section of the tube;

(c) heating said welded section of the tube to between about 1150 degrees F. and 1450 degrees F. by conducting electric current at the power level determined in step (a) through the electrical resistance element of the heater;

(d) maintaining said temperature in said welded section of said tube for a time period between about 8 and 12 minutes, and (e) withdrawing the heater from the tube.

21. The process of claim 20, wherein the emissivity of the sleeved region of the tube is determined by heating this region to incandescence, and optically transmitting a portion of the light of incandescence to a pyrometer.

22. The process of claim 20, further including the step of re-positioning the heater adjacent to another welded section of the tube on order to heat this section at about the same temperature and for about the same time as the first portion.

23. The process of claim 20, wherein the heater radiates heat along a length that is greater than the length of the welded section of the tube so that the entire welded section can be treated at one time.

24. A process for thermally stress-relieving a section of a conduit having an open end and formed from Inconel® 600 by means of an elongated radiant heater having an electrical resistance element, comprising steps of:

(a) inserting the heater into the open end of the conduit and positioning it adjacent to said section of said conduit;

(b) heating said section to between 1150 degrees F. to 1450 degrees F. by conducting electric power through the resistance element of the heater, and (c) maintaining said temperature in said section of said conduit for a time period of between 4 and 6 minutes for each 0.050 inches of wall thickness of said section.

25. The process of claim 24, including the further step of determining the emissivity of the section in order to determine the level of electrical power necessary to conduct through the element of the heater to heat the section to a temperature of between 1150 degrees F. and 1450 degrees F.

26. The process of claim 25, wherein the section is heated to about 1400° F.

27. The process of claim 25, wherein the temperature in said section is maintained for a time period of about 5 minutes for each 0.050 inches of wall thickness.

28. The process of claim 27, wherein the emissivity of the section is determined by heating the section to incandescence, and optically transmitting a portion of the light of incandescence to a two-color pyrometer.

29. A process for thermally stress-relieving the U-bend of a U-shaped heat exchanger tube formed from Inconel® 600 and having an outer diameter of between about 0.680 and 0.880 inches and a wall thickness of between about 0.036 and 0.053 inches by means of a radiant heater insertable within said U-bend, comprising steps of:

(a) inserting said radiant heater into said U-bend;

(b) heating said U-bend to a temperature of about 1300 degrees F. with said heater;

(c) maintaining said U-bend at said temperature of about 1300 degrees F. for a period of about 5 minutes, and (d) withdrawing said radiant heater from said U-bend.

30. A process for thermally stress-relieving the U-bend of a U-shaped heat exchanger tube formed from Inconel® 600 and having an outer diameter of between about 0.680 and 0.880 inches and a wall thickness of between about 0.036 and 0.053 inches by means of an electrically powered radiant heater insertable within said U-bend, comprising steps of:

(a) determining the thermal loss characteristics of said U-bend;

(b) determining the amount of electrical power which must be applied to said radiant heater in order to bring said U-bend to a steady-state temperature of about 1300 degrees F.;

(c) inserting said radiant heater into said U-bend and applying the amount of electrical power determined in step (b) to said radiant heater;

(d) maintaining said U-bend at about 1300 degrees for a period of about 5 minutes by periodically monitoring the temperature of said U-bend by transmitting some of the light of incandescence of the U-bend to a two-color pyrometer while modulating the amount of electrical power applied to said radiant heater; and (e) withdrawing said radiant heater from said U-bend.

* * * * *